US008348492B2

(12) United States Patent
Mier-Langner et al.

(10) Patent No.: US 8,348,492 B2
(45) Date of Patent: Jan. 8, 2013

(54) MOVABLE LED TRACK LUMINAIRE

(75) Inventors: Alejandro Mier-Langner, Providence, RI (US); John Fiegener, Marblehead, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 565 days.

(21) Appl. No.: 12/436,535

(22) Filed: May 6, 2009

(65) Prior Publication Data

US 2009/0279298 A1 Nov. 12, 2009

Related U.S. Application Data

(60) Provisional application No. 61/050,863, filed on May 6, 2008.

(51) Int. Cl.
*H01R 33/00* (2006.01)
*F21V 21/00* (2006.01)

(52) U.S. Cl. ..... 362/648; 362/398; 362/147

(58) Field of Classification Search ..... 362/398, 362/648, 147
See application file for complete search history.

(56) References Cited

U.S. PATENT DOCUMENTS

| | | | | |
|---|---|---|---|---|
| 6,059,582 | A * | 5/2000 | Tsai | 439/121 |
| 7,165,863 | B1 * | 1/2007 | Thomas et al. | 362/219 |
| 7,806,569 | B2 * | 10/2010 | Sanroma et al. | 362/398 |
| 7,828,464 | B2 * | 11/2010 | Wang et al. | 362/294 |
| 2005/0201098 | A1 * | 9/2005 | DiPenti et al. | 362/294 |
| 2009/0244925 | A1 * | 10/2009 | Snagel et al. | 362/648 |

FOREIGN PATENT DOCUMENTS

EP 1733653 A2 * 12/2006

* cited by examiner

*Primary Examiner* — Diane Lee
*Assistant Examiner* — Sean Gramling
(74) *Attorney, Agent, or Firm* — John F. Salazar; Mark L. Beloborodov

(57) ABSTRACT

A magnetic track and lighting system is described. The present magnetic luminaire attaches to a track through magnetic connectors and provides easy mobility of the luminaires on the track without necessary mechanical attachment mechanisms. The magnetic luminaire incorporates the utilization of LED sources and provides in its design cooling and heat dissipation by the interface between the magnetic luminaire and the track.

15 Claims, 6 Drawing Sheets

MOVABLE LED TRACK LUMINAIRE

CROSS-REFERENCE TO RELATED APPLICATION

This application under 35 USC §119(e) claims priority to, and benefit from, U.S. Provisional Application Ser. No. 61/050,863, filed on May 6, 2008, entitled "Movable LED Track Luminaire," which is currently pending naming the above-listed individuals as co-inventors.

FIELD OF THE INVENTION

The present invention relates to a movable LED track luminaire and particularly to a low voltage track system having magnetic LED luminaires which are repositionable on the track.

DETAILED DESCRIPTION OF THE INVENTION

Figure 1:
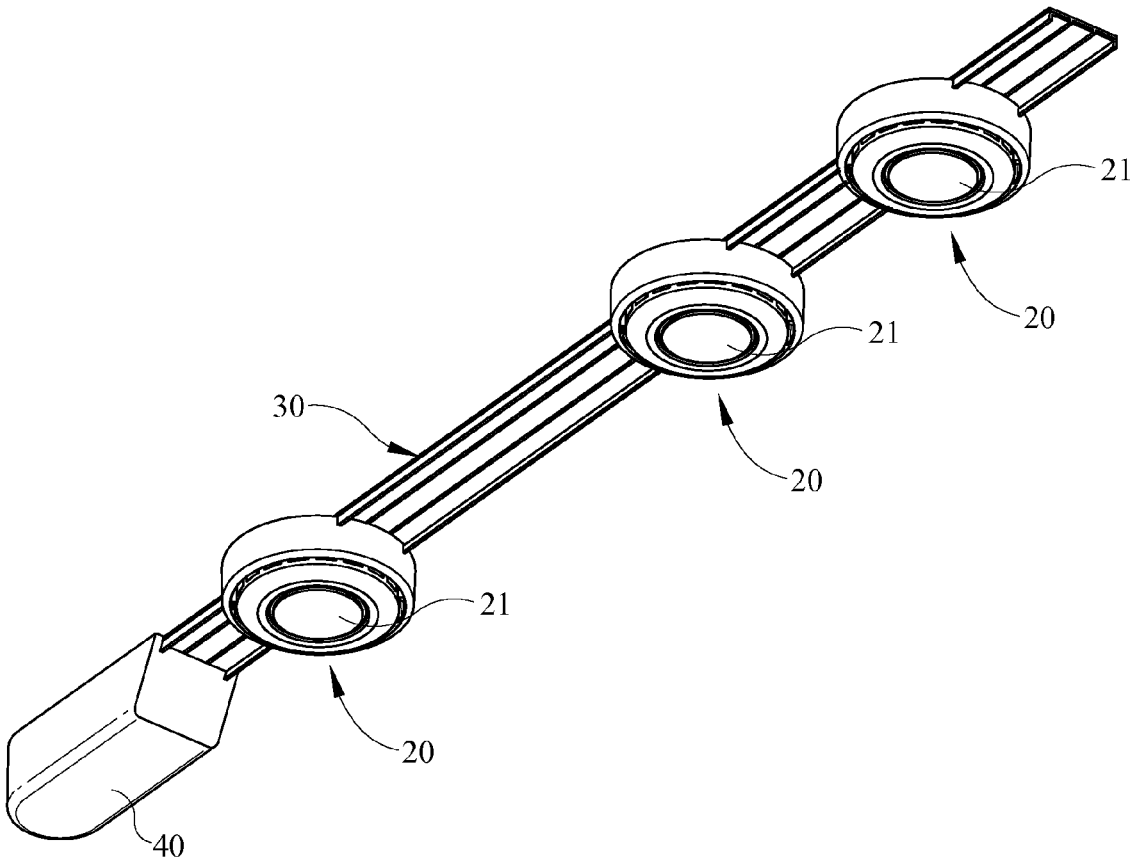
FIG. 1 is a lower view of the track system of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Traditional track luminaires require mechanical affixation of the track luminaire directly to the track or the supporting structure of the track. Located and supported within the track are positioned the line voltage conductors which electrically contact the electrical contacts of the luminaire, the luminaire affixed to a track head, the track head mechanically affixing the luminaire to the track. In such a construction, the track itself supports the luminaire, the track head mechanically enhances or ensures such support and affixation of the track to the track luminaire through a rotary lock or the like. It is desirable however to have a readily movable track luminaire which may be easily moved from place to place on the track and which automatically provides electrical connection between the illumination source or puck and the remote power supply and electrical conductor on the track without any additional mechanical connection between the luminaire and the track and track conductor.

Thus, in the present design combination in FIG. 1, the low voltage track 30 has a track frame 36 which magnetically supports a track luminaire such as an LED light source and luminaire puck 20 depicted. As shown in FIG. 1, primarily the track 30 has a low voltage remote power supply 40 which provides low voltage power to each of the luminaires 20 through a longitudinally extending electrical conductor extending along the track frame, the luminaires in the present example depicting internally an LED light source 21 as the illumination type. Many other types of illumination may be implemented with regards to light sources. The various examples and embodiments depicted herein are in no way considered to be limiting as the mechanical structure and various affixation methods as well as overall designs may be implemented with many types of luminaire and illumination styles. Nothing within the disclosures intended to be limiting in nature as they are provided for exemplary purposes only.

The movable LED track luminaire shown in FIG. 1 may implement multiple luminaire pucks 20 as are shown, each of the pucks magnetically affixed to the track and powered by the low voltage power supply 40. Low voltage power supply 40 may be directly affixed to a line voltage. Each of the magnetic luminaires 20 adhere to the bottom surface of the track 30. The track 30 comprises a track frame 36 which supports the electrical conductor 31 which is surrounded by an insulator sleeve 32. An exposed portion of the electrical conductor 31 provides an electrical contact surface for each of the magnetic luminaires 20 magnetically affixed to the track 30. As depicted additionally in FIG. 2, the track has a track end cap 34 as well as, extending longitudinally within the track, a magnetic support element 33 such as a steel bar and the like to provide a contact surface for magnets placed upon the magnetic luminaire 20 thereby assuring direct contact of the magnets placed within the luminaire 20 and the magnetic support element 33 of the track 30.

Figure 2:
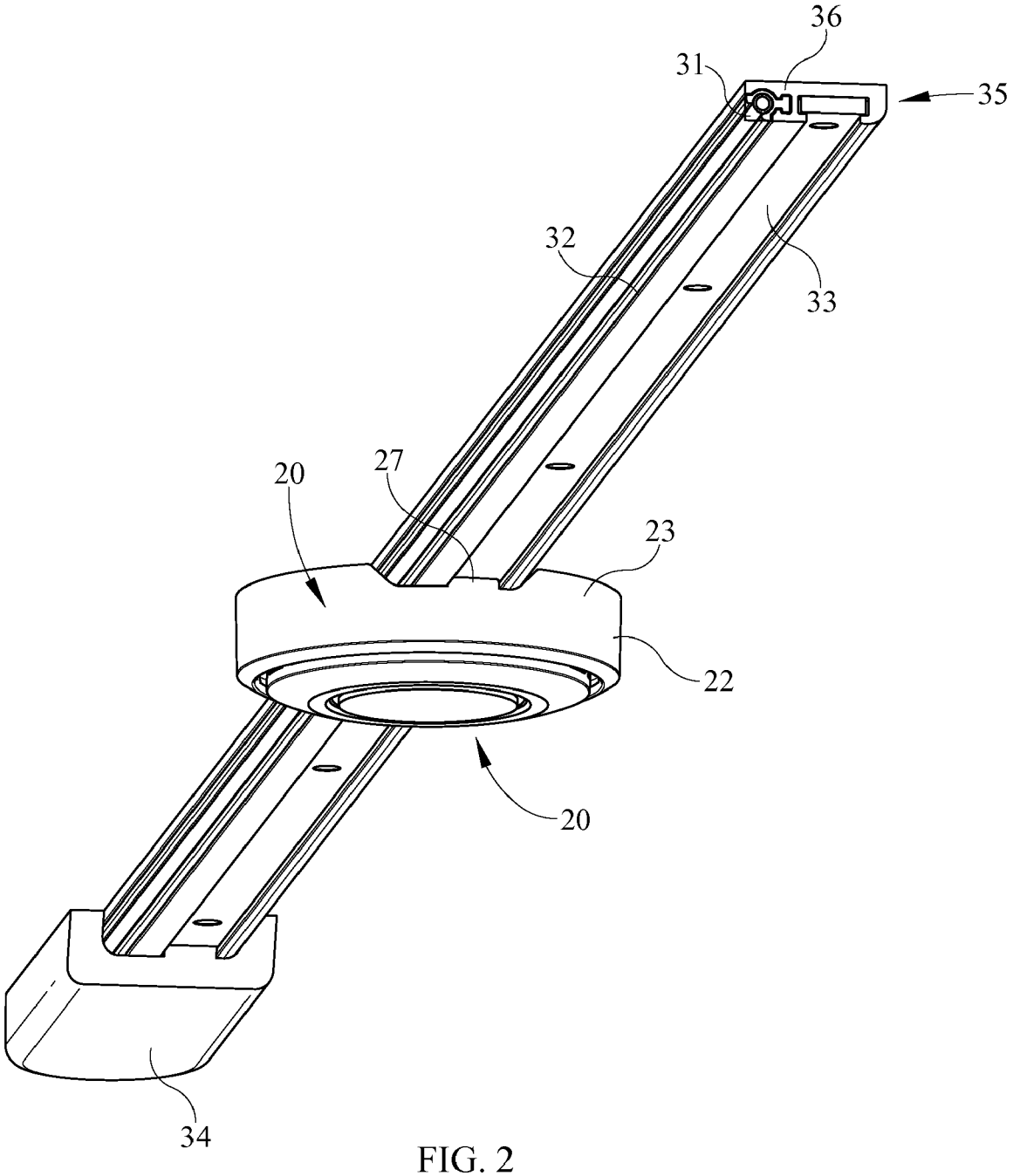
FIG. 2 is a close up of the luminaire and track of FIG. 1.

As may be seen from FIG. 2, a large width of magnetic support element 33 is exposed on the underside of the track allowing for good surface contact between the magnets retained within the housing 22 of the magnetic luminaire 20 and the magnetic element 33 retained within the track frame 36. Of course, as the design disclosed within the present embodiment depicts the magnets placed upon the magnetic luminaire 20 and within the housing 22 of the magnetic luminaire in combination with the magnetic element or steel bar 33 affixed within the track frame 36, the opposite may be easily and readily implemented depending upon the nature and construction desired. Thus, magnets and metalized contact areas may be reversed as opposed to those exemplary embodiments depicted within the figures.

As is shown again in FIG. 2, the opposing edge of the track frame 36 away from the electrical conductor 31 has a slight radius edge 35, the track radius 35 as shown adjacent to the position of the magnetic element or steel bar 33. Track radius 35 shown within the figures ensures good contact with the neutral contact position on the housing 22 of the magnetic luminaire 20, each of the contacts further discussed herein below. The track radius 35 shown may be implemented to utilized proper keying or positioning with respect to the puck and track interface. In other words, if desired, the track and interface of the luminaire 20 may be designed such that the luminaire 20 may only be placed on the track and magnetically affixed to the track in one orientation thereby disallowing rotation of 180 degrees and connection of the luminaire on the track in such rotated position thereby ensuring proper polarity, contact positioning, optimal magnetic interface and the like.

Figure 4:
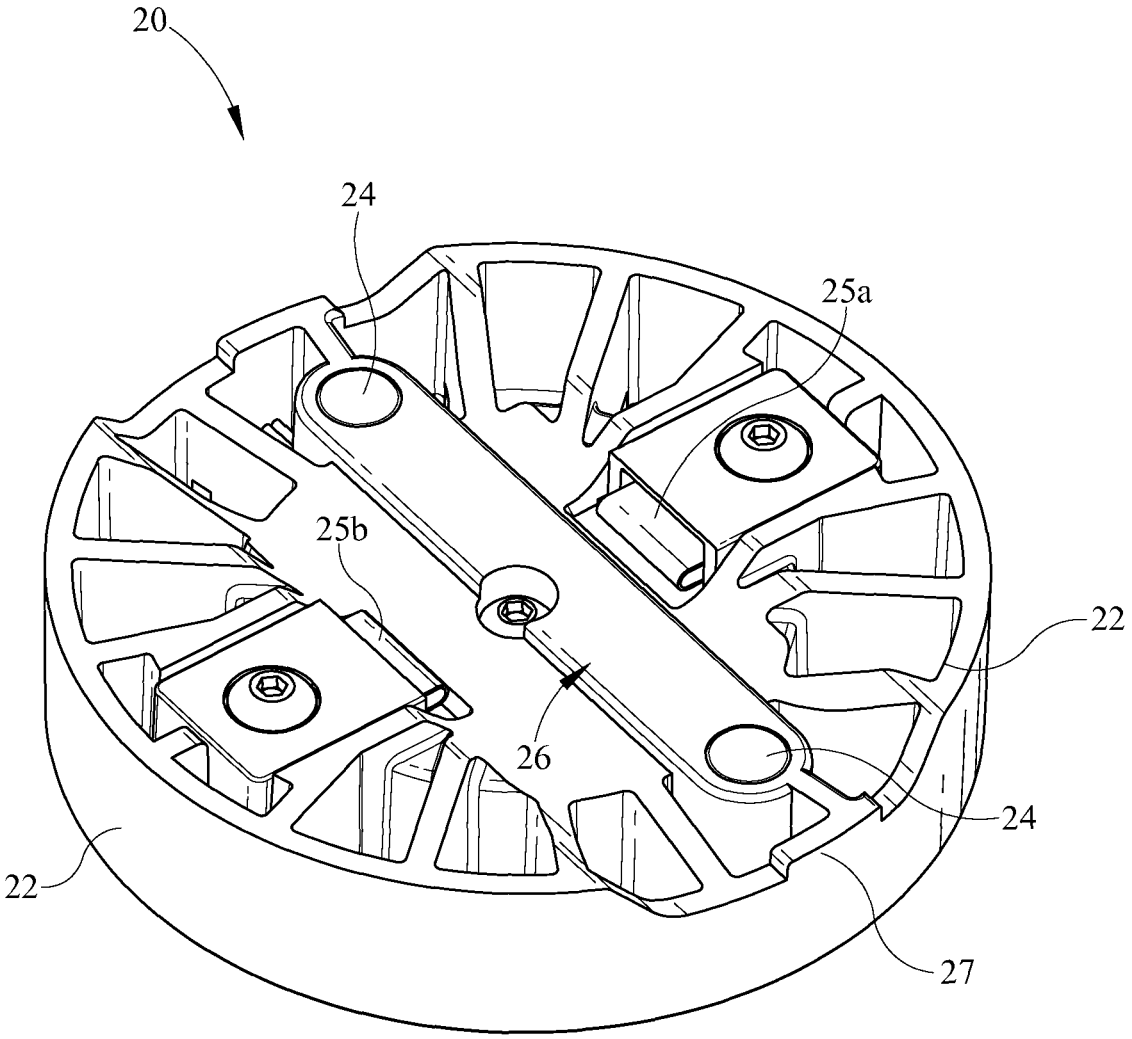
FIG. 4 is a top view of the luminaire of FIG. 2.

Additionally, as shown with regards to the track construction in FIGS. 1 and 2, the track frame 36 carries the electrical conductor 31 which is electrically connected to the remote power supply 40. The electrical conductor 31 may be surrounded substantially by an insulator sleeve 32 to prevent conducting directly to the track frame 36. As shown in the present embodiment, the opposing surface of the track frame 36, namely the track radius 35, may provide the contact surface area for neutral contact for the magnetic luminaire 20. Thus, adequate electrical contacts positioned on the luminaire 20 may be provided to ensure that electrical communication between the illumination device within the housing 22 may occur both between the electrical conductor 31 and the neutral contact of the track frame 36, in this embodiment the track radius 35. The track radius edge 35 is provided with such a radius to ensure good contact between the magnetic track luminaire 20, the neutral electrical contact 25A, and the energized electrical contact 25B, both of which are shown in FIG. 4. Further, as mentioned previously, the insulator sleeve may be provided to ensure proper separation of the low voltage power with the remaining track body as is necessary.

Figure 3:
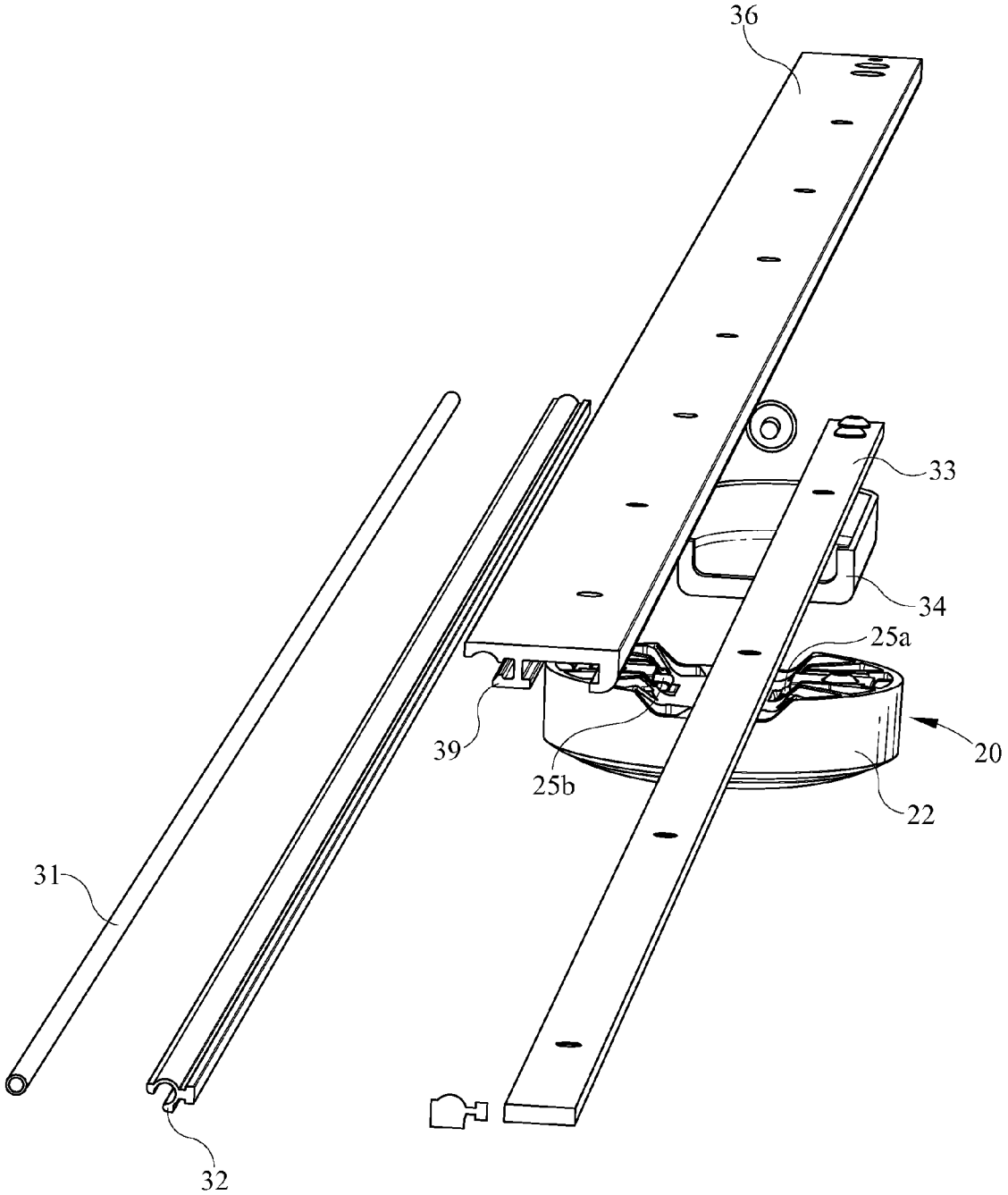
FIG. 3 is an exploded view of the track and luminaire of FIG. 1.

Turning to FIG. 3, the electrical conductor 31 is shown which is surrounded by the insulator sleeve 32, as combined inserted within the track channel 39 which receives the insulator sleeve, the insulator sleeve thermally retaining the electrical conductor 31 in position. Channel 39 is keyed to properly receive the insulator sleeve as depicted, the insulator sleeve having an opening or gap to receive the electrical conductor along its length thereof and properly having said gap also to expose the electrical conductor 31 for electrical communication between the electrical conductor and the magnetic luminaire 20 and electrical contact 25B. The track frame 36 also has an additional channel for receiving the steel bar or mounting mechanism 33 which acts as the magnetic interface between the magnetic luminaire 20 and the track frame 36. As shown, the track frame 36 may be directly mounted to the bottom surface of a ceiling or other similar structure or may be suspended as desired. Many various embodiments of the track frame and configuration of the frame, electrical conductor 31, steel bar or luminaire mount 33, track end cap 34, low voltage power supply 40 and other structure may be implemented. Such configuration changes may be utilized while still maintaining implementation of the various magnetic luminaire track features depicted herein.

Also as is shown in FIG. 3, the exposed electrical contacts 25A and 25B, namely the neutral contact 25A and the hot contact 25B, are shown in their proper orientation with respect to the mounting bar 33. It is desirable that the mounting bar 33, as mentioned, be of sufficient width and exposed surface area to ensure strong and proper magnetic interface and contact between the magnetic luminaire 20 and the track frame 36 to ensure that the magnetic luminaire maintains position on the track during use.

Turning to FIG. 4, the interface area of the magnetic luminaire 20 is depicted wherein the luminaire body and heat sink 22 are depicted. It may be desirable that a number of magnetic luminaires 20 may be implemented and retained on the track frame 36 as shown, the track frame 36 properly supporting itself and a plurality of magnetic luminaires 20. Additionally, it is desirable that the track frame incorporate the utilization of a low voltage power supply sufficient to power a plurality of similarly placed luminaires 20, the voltage of the track being maintained at 24 volts DC with the power supply preferably being a Class II 50 watt dedicated voltage 120 volt AC low profile power supply. Depending upon the type of power supply implemented, as many implementations may be utilized, a plurality of pucks or magnetic luminaires 20 may be implemented and engaged and supported by the track frame 36, for example ten luminaires 20, as may be desired.

Returning to FIG. 4, the underside and contact area of the luminaire 20 is shown including the magnetic luminaire body or housing and heat sink 22. The housing 22 may be made of an aluminum alloy, die cast grade, and as shown may be designed to act as a heat sink for the illumination source 21, in this example a plurality of LEDs. As is known in the art, LEDs generate sufficient heat to require preferably a proper heat sink and heat dissipation characteristics in the housing. As shown in FIG. 4, the housing hereof incorporates the utilization of the heat sink within the body and housing element which incorporates a plurality of radially extending fins extending to the exterior sidewall of the luminaire housing 20. As is also shown in FIG. 4, the magnets 24 are positioned on either end of the magnetic luminaire 20 and are sufficient rare earth magnets of high enough strength to properly and adequately support the magnetic luminaire 20 on the track. The magnets 20 are positioned on either end of the recessed area extending across the underside of the magnetic luminaire 20 thereby providing even support for the magnetic luminaire.

Also shown in FIG. 4 are the dual electrical contacts 25A and 25B, one provided for a hot connection and one provided for a neutral connection. The neutral electrical contact 25A is adjacent to the magnets and polarity pad 26 in the present embodiment although many constructions may be implemented. As previously discussed, the hot electrical contact 25B is positioned so as to properly contact the exposed portion of the electrical conductor 31 mounted within the track and having a exposed arcuate area. The electrical contacts 25B and 25A are positioned and designed so as to provide adequate electrical communication between the contact areas of the track and the electrical contacts 25A, 25B themselves of the luminaire by mere placing the magnetic luminaire 20 onto the mounting surface 33 of the track. Thus, narrow tolerance is provided to ensure adequate electrical communication between said contacts and the proper conductive area of the track.

Figure 5:
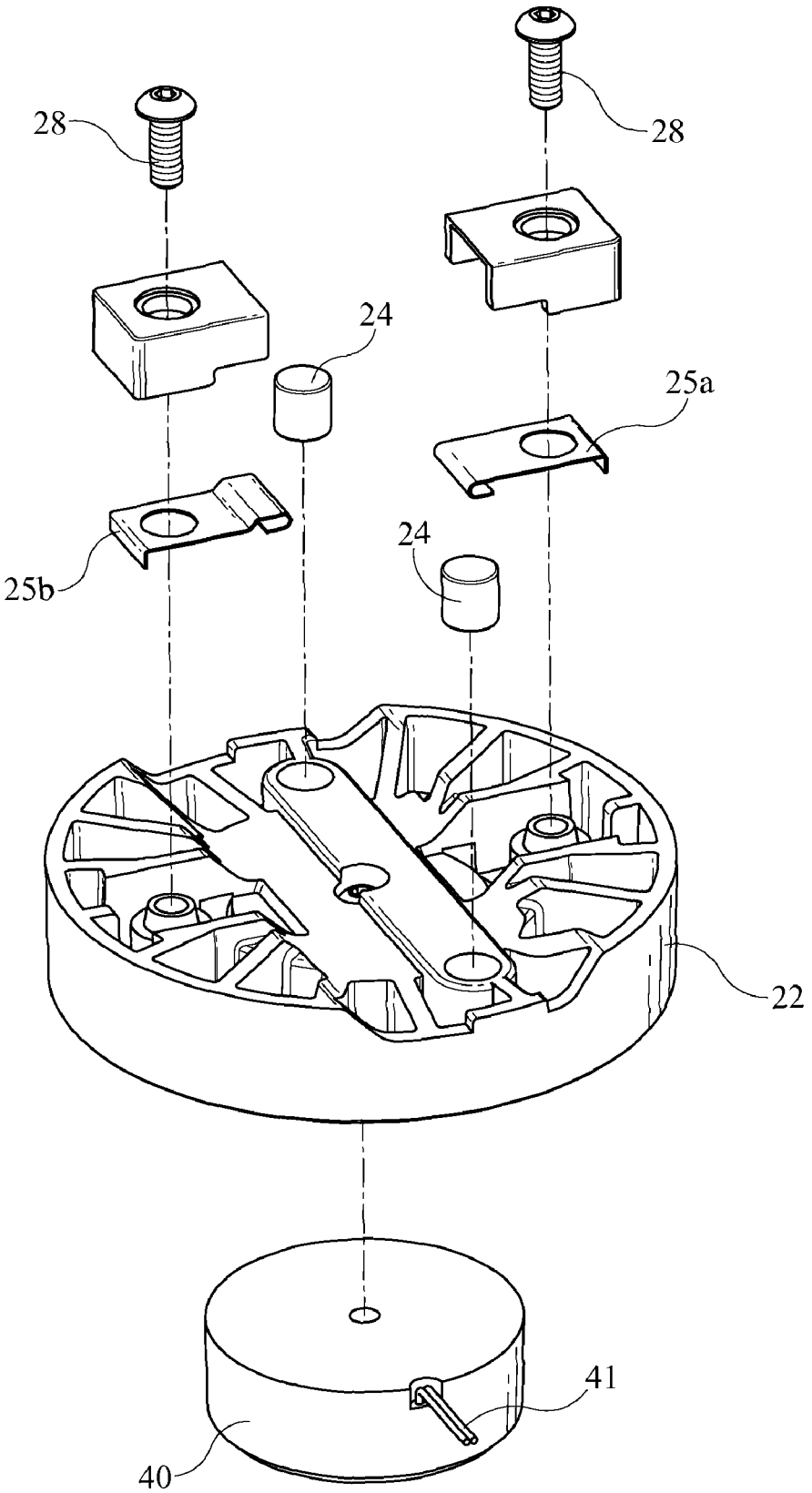
FIG. 5 is a partial exploded view of the luminaire of FIG. 2.
Figure 6:
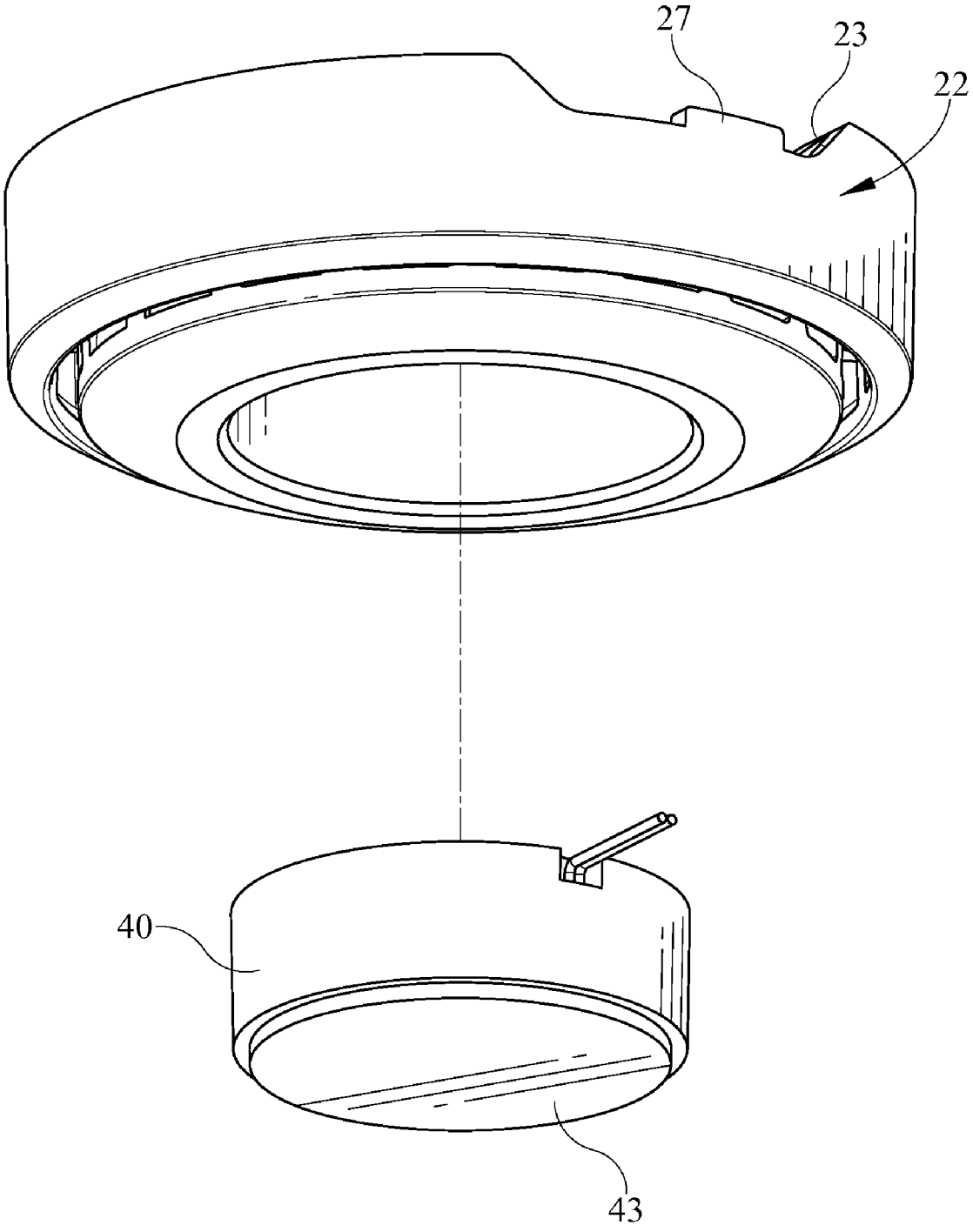
FIG. 6 is a disassembled view of the luminaire and light source of FIG. 2.

Turning to FIG. 5, an exploded view of the magnetic luminaire 20 is shown including the housing and heat sink 22 as well as the various mechanical attachment mechanisms for the electrical contacts 25A and 25B which incorporate the use of fasteners and the like to affix the contacts 25A, 25B directly to the housing 22 on the underside thereof Also shown is the LED light source 40 which may be, in the various embodiments depicted a separate cylindrical package inserted within a recessed area of the housing as may be determined and seen within FIG. 5 and FIG. 6. A central recess area within the luminaire body 20 may receive the cylindrically shaped LED light source 40 if desired. Various other implementations such as unibody construction may also be implemented. However, in the present embodiment, separate implementation of the light source 40 and the magnetic luminaire body 20 is implemented for easy depiction and construction.

As shown, the illumination source 40 has a set of wires 41 which may be in electrical contact with the various electrical contacts 25A, 25B of the magnetic luminaire 20, the wires 41 extending and properly connecting to the contacts as are necessary. As previously indicated, it is desirable to ensure proper heat transfer between the light source 40 and the magnetic luminaire body 20 in order to provide adequate heat dissipation between the LED illumination source and the air to prevent overheating and the like and to ensure proper operation of the LEDs or the light source depicted. Additionally, the design depicted herein is such that limiting heat transfer from the luminaire body 20 directly to the track is implemented. As shown in FIG. 6, a separation tab 27 is formed within the luminaire housing 22 and extends upward directly adjacent the areas where the magnetic connectors are positioned on the underside of the luminaire body. The upwardly extending separation tab and other structure, shown in FIG. 4, properly suspends a majority of the magnetic luminaire 20 away from the track and away from the mounting bar 33 by positioning the uppermost portion of the magnets at a distance sufficiently away from the base of the magnetic luminaire body to allow air to flow through the area between the magnetic luminaire 20 and the track 30. Thus, while there is physical contact between the magnets 24 and the mounting bar 33 of the track and track frame 36, a gap of approximately ⅛ of an inch is provided to allow air flow between the puck and the track to ensure proper cooling in those areas susceptible to high heat generation. As may be noted, tab 27 formed on the magnetic luminaire and luminaire body 22, may be a raised portion extending from one side of the luminaire body 22 to the other extending longitudinally thereof Such structure or tab 27 as is depicted separates the top most position of the magnets 24 and the remaining body portion of the housing 22 such that adequate air flow may extend through the longitudinal area formed between the tabs 27 on either side of the housing 22 and/or between the puck housing and track.

Returning to the design depicted in FIG. 6, the light source 40 in the present embodiment incorporates a three LED pack as the illumination source. The light source 40 may be mechanically affixed to the interior of the luminaire body 22. Interposed between the LED light source and the body 22 may be grease or other graphite material which may constitute a heat transfer media allowing heat to transfer between the light source 40 and the body 22. Many variations of heat transfer agents may be utilized and mechanical attachment mechanisms may be implemented between the two items depicted for proper securement and heat transfer characteristics as desired.

As is also shown, wiring 41 extends outward from the light source 40 through the interior of the housing 22 and to the contacts 25A and 25B as are shown, the light source 40 requiring power from the remote power supply through the to properly illuminate. In the present embodiment, as mentioned, a three LED pack design is depicted wherein each of the LEDs, in this example are designed to produce 52 lumen at approximately 300 mA. For each of the light sources 40 provided may be a built in driver to drive the multiple LEDs shown at the proper illumination characteristics. In the present embodiment and for exemplary purposes, the driver may be a 24 volt regulated driver providing power to the LEDs as is necessary. However, many alternative electrical characteristics and driving characteristics may be implemented dependent upon the specific illumination output and characteristics of the light desired as well as the particular LED packs and specifications as are necessary. It is desirable however to provide such a low profile light source 40 such that the entire magnetic luminaire 20 may be aesthetically pleasing and directly contact the track without significant extension away from the track itself and track frame.

In the various embodiments depicted, a three LED light source may be implemented within the light source 40, the triple LEDs covered by a lens 43 or other optical or light modification device, and which allow modification of the light emitted from the illumination device or LEDs in the present embodiment as is necessary. As is shown in the multiple figures, a plurality of magnetic illumination devices 20 may be electrically communicating with the low voltage power supply dependent on the power supply utilized and the various characteristics of the magnetic luminaires 20. Significant numbers of magnetic luminaires 20 may be affixed to the track as desired, each of which may be readily and easily moved from position to position on the track as desired by the end user without the necessity of the end user mechanically affixing the luminaire to the track through the use of a mechanical track head which, customarily, has been a rotary lock type mechanism or device. The magnetic luminaire and track combination as are depicted, provides easy case lighting in under cabinet environments which may be installed in confined spaces allowing the reposition of the magnetic luminaires as are desirable on an easy and ready basis. Utilizing the implementation mechanisms as depicted on a magnetic track system provides flexibility not found in existing track luminaire systems while allowing more luminaires to be added or removed as desired and repositioned as necessary. The track as required may be polarized and fitted as depicted with the support member to support the additional luminaires shown in the figures allowing the user to simply remove the magnetic luminaire 20 from the track frame 36 by merely pulling off the luminaire from the track and reinstalling wherever necessary.

The foregoing description of structures and methods has been presented for purposes of illustration. It is not intended to be exhaustive or to limit the invention to the precise steps and/or forms disclosed, and obviously many modifications and variations are possible in light of the above teaching. It is understood that while certain forms of the low pressure forced air heater have been illustrated and described, it is not limited thereto except insofar as such limitations are included in the following claims and allowable functional equivalents thereof.

The invention claimed is:

1. A track and magnetic luminaire, comprising:

a track frame supporting a non-energized mounting bar and a separate electrical conductor, both said mounting bar and said electrical conductor extending longitudinally along the length of said track frame, said electrical conductor in electrical communication with a low voltage power supply adjacent to said track frame;

an insulator sleeve surrounding at least a portion of said electrical conductor and mounted within said track frame in a track channel with said electrical conductor, said insulator sleeve exposing at least a portion of said electrical conductor for electrical communication with said low voltage power supply;

a magnetic luminaire magnetically repositionable on said track frame, said magnetic luminaire having a first and a second contact, said first contact electrically contacting said electrical conductor of said track frame, said second contact of said magnetic luminaire contacting said track frame;

said magnetic luminaire further having at least one magnet in corresponding alignment with said mounting bar of said track frame to magnetically support said magnetic luminaire on said track frame;

said magnetic luminaire further having an LED light source, said LED light source in electrical communication with said first electrical contact of said magnetic luminaire;

said LED light source allowing heat dissipation and transfer from said LED light source to said magnetic luminaire, said magnetic luminaire having a heat sink housing allowing heat to be readily dissipated from said magnetic luminaire;

wherein said magnetic luminaire is separated from said track frame by a sufficient distance to allow air flow between said magnetic luminaire and said support bar and around said at least one magnet retained within said magnetic luminaire.

2. A magnetic track attachment for track style luminaires, comprising:

a track having a track frame retaining an insulated electrical conductor in a track channel and a separate non-energized support bar, said conductor electrically connected to a power supply and separated from said support bar;

a magnetic luminaire having an LED light source retained within a housing and in electrical conductive relationship with said power supply and said track frame;

said housing having at least one magnet magnetically attracted to said support bar and positioned on a rear surface of said housing, said rear surface of said housing additionally supporting a first and a second electrical contact;

said luminaire further having circuitry for driving said at least one LED and electrically connected to said first and second contacts;

wherein said at least one magnet positions said luminaire away from said track to provide an adequate cooling air gap to allow air to flow between said track and said luminaire.

3. The magnetic track attachment of claim 2 wherein said electrical conductor is partially surrounded by an insulator sleeve exposing the longitudinal arc section of said conductor and allowing contact with said first contact of said housing.

4. The magnetic track attachment of claim 2 wherein said LED light source is a separate light source retained within said housing and, interposed between said housing and said LED light source is a heat transfer agent allowing efficient heat transfer from said light source to said housing.

5. The magnetic track attachment of claim 2 including a radiused edge on said track frame to ensure direct contact between said second contact of said housing and said track frame.

6. The magnetic track attachment of claim 2 wherein said at least one magnet is a pair of spaced magnets positioned upon either end of a track receiving area on said rear surface of said housing.

7. The magnetic track attachment of claim 2 wherein said housing includes a contact spacing tab to separate said magnetic luminaire from said track frame.

8. The magnetic track attachment of claim 2 wherein said magnetic luminaire circuitry includes a built-in driver to properly drive said LED.

9. The magnetic track attachment of claim 2 wherein said housing has a plurality of cooling fins interior of said housing.

10. A magnetic puck style track luminaire for use with a track lighting system, comprising:

a track frame retaining an electrical conductor along said track substantially surrounded by an insulative sleeve and exposing a longitudinal arc shaped length of said conductor, said electrical conductor and insulative sleeve inserted within a track channel of said track;

a metalized non-energized support bar affixed within said track frame and separated from said track channel and said electrical conductor;

a puck style luminaire having a light source maintained within a housing, said housing having a track engagement surface extending along the length of a rear face of said puck style luminaire;

said track engagement surface including a first and a second electrical contact to engage said track frame along separate sections, a first section being said electrical conductor, a second section being said track frame;

at least one magnet retained within said track engagement surface to magnetically contact said support bar.

11. The magnetic puck style track luminaire of claim 10 wherein said light source is an LED style light source fittingly retained within an opening of said housing.

12. The magnetic puck style luminaire of claim 11 further including a heat transfer agent interposed between said LED style source and said housing to allow for the efficient transfer of heat from said LED style source to said housing.

13. The magnetic puck style track luminaire of claim 10 wherein said puck style luminaire is suspended away from said track a sufficient distance to allow air to flow between said track and said puck style luminaire.

14. The magnetic puck style track luminaire of claim 12 wherein said housing has a plurality of cooling fins radially extending in an interior area of said luminaire housing.

15. The magnetic puck style track luminaire of claim 10 wherein said second electrical contact is directly adjacent a radiused edge of said track frame.

* * * * *